United States Patent [19]

Takashima

[11] 4,243,210

[45] Jan. 6, 1981

[54] TUNDISH FOR THE CONTINUOUS CASTING OF STEEL

[75] Inventor: Masaru Takashima, Komae, Japan

[73] Assignee: Aikoh Co. Ltd., Tokyo, Japan

[21] Appl. No.: 42,886

[22] Filed: May 29, 1979

[30] Foreign Application Priority Data

Jun. 5, 1978 [JP] Japan ..... 53/66635

[51] Int. Cl.[3] ..... C21C 5/48

[52] U.S. Cl. ..... 266/220

[58] Field of Search ..... 266/220

[56] References Cited

U.S. PATENT DOCUMENTS

| | | | |
|---|---|---|---|
| 2,811,346 | 10/1957 | Spire | 266/220 |
| 2,947,527 | 8/1960 | Spire | 266/220 |
| 3,330,645 | 7/1967 | Moustier | 266/220 |
| 3,343,829 | 9/1967 | Coates | 266/220 |
| 3,541,604 | 11/1970 | Nomura | 266/220 |
| 3,633,898 | 1/1972 | Josefsson | 266/220 |
| 3,773,226 | 11/1973 | Kutzer | 266/220 |
| 4,139,184 | 2/1979 | Griffith | 266/220 |

*Primary Examiner*—P. D. Rosenberg
*Attorney, Agent, or Firm*—Fay & Sharpe

[57] ABSTRACT

A tundish for the continuous casting of steel, which is equipped with excellently easily-separable gas blowing elements consisting of an assembly of a gas-permeable refractory moulding and a less gas-permeable refractory shell, the gas permeability of which is less than 1/5 that of said moulding.

11 Claims, 8 Drawing Figures

TUNDISH FOR THE CONTINUOUS CASTING OF STEEL

This invention relates to a tundish for the continuous casting of steel, in which the tundish with gas blowing element for refining molten steel has been improved in the separability of said element so as to make the tundish convenient for repair after a continuous casting operation of same.

It is known that by blowing porous plug provided in a tundish into molten steel flow there are obtained effective results such as prevention from the floating-up of inclusions in molten steel, degassing and the contraction of pouring nozzle before the molten steel is discharged from the tundish through the pouring nozzle. However, the porous plug used in this means is one for discontinuous use in conventional ladle, its shape being a frustum of a cone. In cenventional tundish, it is provided with a casing body made of thin steel plate from the bottom to the side surface to avoid gas leakage, one end of said casing body is connected to a gas supply piping, the outer shell of the tundish is bored with a mounting hole into which said piping is inserted from the exterior to be totally fitted to the support brick of the lined refractory materials, and the support brick is further reinforced with brick applied from its outside thereby paying attention not to cause danger of melt leakage even if the porous plug is damaged. Discontinuous use of ladle is a handling of the ladle under severe conditions of repeated heating and cooling in a manner. In tundish for the continuous casting of steel it is in continuous contact with molten steel at almost constant temperature and under constant pressure during a continuous casting operation, but if the materials and making process of the porous plug of ladle are followed as they stand there will be no problem and it has been found that the shape of porous plug suitable for tundish can be simplified.

The object of the present invention is to provide, as an improved substitute for porous plug fit for tundish, easily-separable gas blowing element which is separated down by turning over the tundish after a continuous casting operation and which need not specific operation for the separation.

In order that the invention may be more clearly understood some embodiments thereof will be described, by way of example, with reference to the accompanying drawings, in which.

Figure 1:
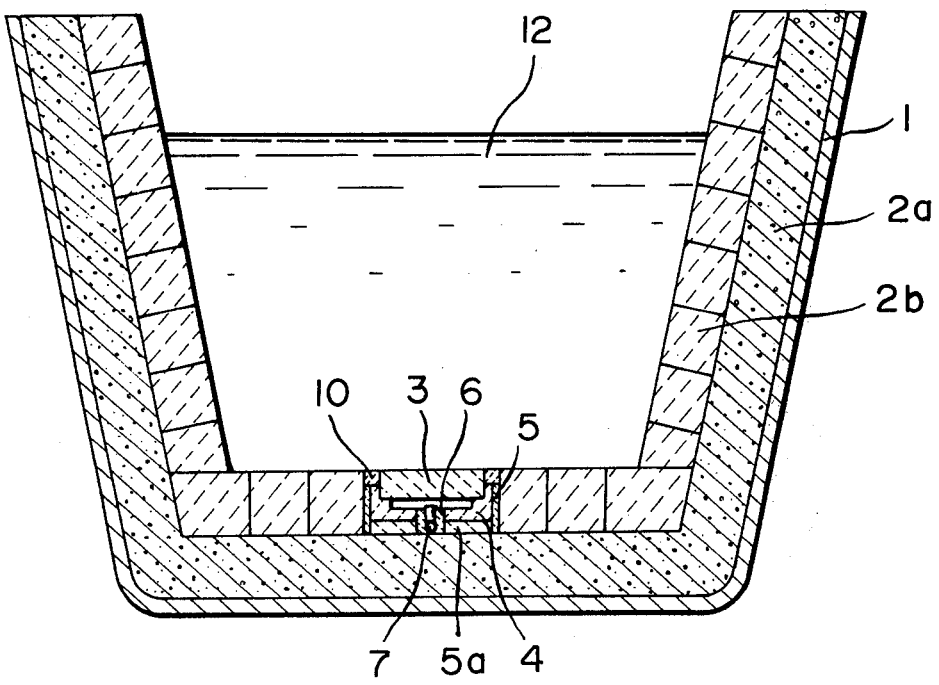
FIG. 1 is a sectional view of a tundish in which an easily-separable gas blowing element is provided.

The easily-separable gas blowing element according to the invention is arranged within the lined refractory materials without working the outer shell of tundish. Referring to the drawings, in FIG. 1 an assembly arranged on the bottom floor of lined refractory materials *2a, 2b* within a tundish outer shell 1 is combined with a less gas-permeable refractory shell 4 which encloses and fixes a gas-permeable refractory moulding 3, and nearly at the central portion of the bottom of said shell 4 there is provided a gas guiding hole 6 to guide a draft pipe 7 to take gas in. For the gas-permeable refractory moulding 3 it will suffice to follow the materials and making process of conventional porous plug as they stand. That is, said moulding bases on high heat-resistant refractory materials such as mullite, corundum, alumina, silicon carbide, zirconia, zirconium silicate and the like, with the addition of a small amount of binder and organic materials. The mixture is moulded, dried and fired. Pores are important element for giving gas permeability, and conventionally standard for permeable degree has been put upon the porosity. Since the porosity and the gas permeability are not necessarily in correlation, however, it is unsuitable to express the gas permeability with the porosity.

Accordingly, in the present invention there is adopted a system of expressing the permeable amount of gas with the unit "$cm/cm^2 \cdot sec. \cdot cm\ H_2O$" (gas amount c.c. which passes at one second through a 1 cm thick sample per 1 $cm^2$ under pressure of 1 cm water column), which is conventionally used to indicate gas permeating degree of sand mould. For said gas permeable refractory moulding 3 is required a permeating amount of more than 0.9 $cc \cdot cm/cm^2 \cdot sec.\ cm\ H_2O$.

Conventionally the more in gas permeable amount the better. However, it is possible to blow more than one liter of gas per minute at unit area 1 $cm^2$ even in a 20 cm thickness if there is a 0.5 atmospheric pressure (gauge pressure) even if the gas pressure is lowered, in consideration of heat resistancy and impact resistancy. On the other hand, preferably the pore dimension is approximately less than 30 microns to secure a permeability sufficient to prevent the entry of molten steel, and it is most suitable to make the pores uniform in 30 microns.

The configuration of said gas-permeable refractory moulding 3 was conventionally of a frustum of a cone, and the gas blowing area was small compared with the diameter of the moulding. However, unlike in the case of ladle the support brick need not be large-sized so that it is possible to make said gas-permeable refractory moulding square-shaped to enlarge the top area. As a refractory material which surrounds said gas-permeable refractory moulding there is provided a refractory shell 4 having less gas-permeability. Said shell 4 fixes said gas-permeable refractory moulding 3 to effect smooth blowing of gas so that it is desired to make the permeability as less as possible and the refractoriness and mechanical strength as high as possible. Nevertheless, as an extent of placing them at practical use, the leakage of the gas guided to said moulding 3, from said shell 4, becomes almost zero if the permeability of said shell 4 is set 1/5 that of said refractory moulding 3 thereby eliminating the trouble of damaging the lined refractory materials in the vicinity by draft. Further, as mentioned above, high fire resistancy and mechanical strength are required for said shell 4, but in case it is not required to give collapsible properties by heating to the shell 4 it will suffice to provide a shell in which there are tightly filled acid, neutral and basic refractory materials such as silica, agalmatolite (Roseki), chamotte, alumina, magnesia, dolomite, chromium and zirconia which are similar to the materials of general refractory bricks, and they are moulded and baked. It will be all right if said sheel has a refractoriness of approximately more than SK 34. Mechanical strength will suffice if it is more than 100 $kg/cm^2$ at pressure resistant strength (at room temperature).

Furthermore, in the case of requiring properties collapsible by heating there are selected one or more of the refractory materials wherein the above materials are added with asbestos, rock wool, slag wool, glass wool, carbon filters, silicon carbide fibers, and kaolin fibers. To give collapsible properties by heating, said mixed materials are further added with materials based on carbonaceous high molecular compounds such as either graphite, coke, charcoal or resin, protein, carbohydrate, fibers, viscous matters, heavy mineral oil, gum matters which are organic substances. Most of these materials act as binder besides giving collapsible properties, and in the case of using organic binder the inorganic binder such as water glass or sodium phosphate need not be used in most cases.

Being mixed with organic materials in the shell 4 having collapsible properties by heating, it is all right if the moulding be heated and solidified at a temperature of such an extent that the binder is hardened, after drying without baking. The materials of the shell having collapsible properties by heating become, when said shell not collapsible by heating is used, elements of the easily-separable gas blowing member by being used for a non-fired refractory moulding 5 which is provided at the outside of the shell and which has collapsible properties by heating. When less gas-permeable refractory shell is constituted by a non-fired refractory moulding having collapsible properties by heating, it is difficult to make the permeable degree 1/5 that of the gas-permeable refractory moulding 3, and therefore it will be necessary to treat the surface with gas-impermeable process.

The gas impermeable treatment of said shell may be carried out in either way of sealing, before drying, the surface with a mixed paste of fine powder of glass matter, ceramic and the like with inorganic binder, or of closing the surface clearance by spraying thereto their molten materials. It is another way of effecting the gas impermeable treatment to dip the moulding for a short time into a bath of molten glass glaze, but in such a case the moulding must be drawn up before the mixed organic substances. By so doing, it is possible to maintain the permeability of said moulding 1/5 that of the gas-impermeable refractory moulding though not ensuring a complete impermeability.

Figure 2:
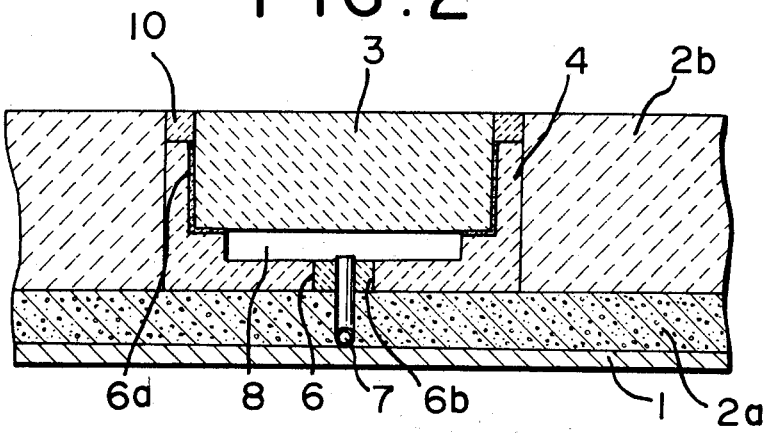
FIG. 2 is a sectional view showing one embodiment of the invention, which has a less gas-permeable refractory shell having collapsible properties by heating.

As shown in FIG. 2, in assembling the gas-permeable refractory moulding and the less gas-permeable refractory shell they are filled with a refractory cement mortar 6*a* for adhesion. In assembling, the motor 6*a* is applied to the contact surfaces of said moulding and said shell and they are pressurized or adhered before they are dried for solidification. In other way, the assembly may be resintered if the shell is a fired article not collapsible by heating. The bottom of said shell is provided with a gas guiding hole 6 into which a draft pipe 7 is inserted. The draft pipe 7 usually is projected slightly from the recess surface of said shell, and the space formed with said gas guiding hole 6 is sealed air-tight with a motor 6*a* same as the refractory cement mortar used for the adhesion of said shell. Said draft pipe 7 is positioned above the floor level of the shell to avoid entry of mortar thereinto and closure thereof, but it is preferable that the floor surface of the shell has a recess to conveniently receive the head portion of the draft pipe 7 and form a gas separation chamber 8 after assembling the gas blowing elements.

The non-fired refractory moulding having collapsible properties by heating is provided at either side panel 5 or bottom surface plate 5*a* of the shell or in their joint use when said shell has no collapsible properties by heating.

Figure 3:
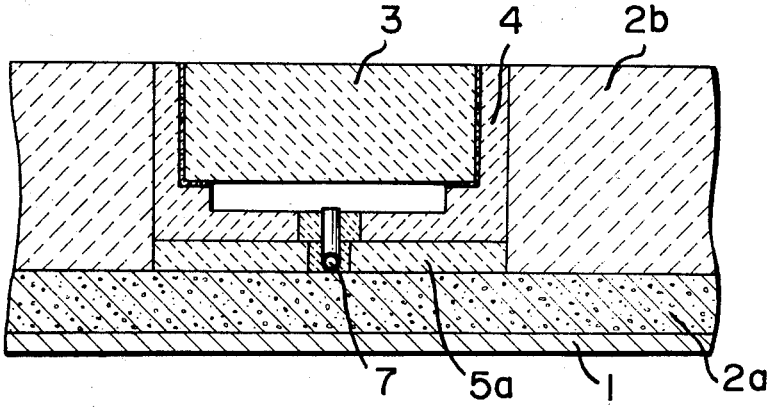
FIG. 3 is a sectional view of the easily-separable gas blowing element of the invention, in which is provided as a bottom surface plate a non-fired refractory moulding having collapsible properties by heating.
Figure 4:
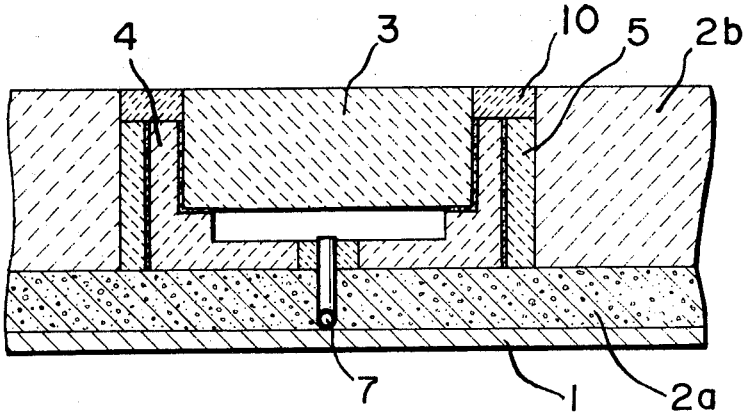
FIG. 4 is a sectional view of the easily-separable gas blowing element of the invention, in which is provided as side panel a non-fired refractory moulding having collapsible properties by heating.
Figure 5:
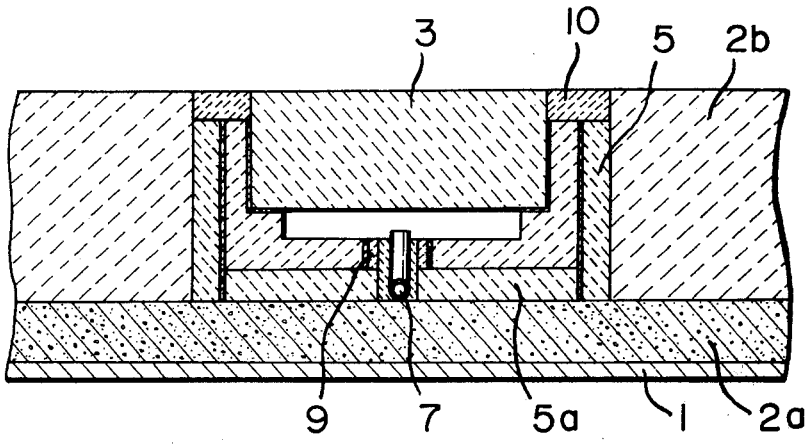
FIG. 5 is a sectional view of the easily-separable gas blowing element of the invention, in which is provided as both bottom surface plate and side panel a non-fired refractory moulding having collapsible properties by heating.

As shown in FIGS. 3, 4 and 5, the materials of the moulding consist of a mixture of refractory and organic ones, said moulding having been manufactured at a low temperature necessary for drying or hardening as referred to above. Said materials act to give collapsible properties to the moulding because of burning-out or decomposition of the organic substances when the moulding is subjected to a high temperature. Therefore, it is advantageous for said moulding that the side panel 5 as well as the bottom surface plate 5*a* is subject to heat at the possible longest delay, and the upper end portion of said side panel 5, which is contacted by melt, is applied with a sealing mortar 10, but in case the side panel is not used the mortar need naturally not be applied. The mortar material may be the same as the refractory cement mortar for assembling said gas blowing elements. As said mortar, one of more than SK 34 in heat resistancy can be used.

Said cement mortar is used all over the contact portions in mounting the gas blowing element, but the gas guiding hole 6 at the bottom floor surface of said shell is sometimes inserted with a separable sleeve 9 which gives collapsible properties by heating, besides with mortar, whereby the easy separability is accelerated. Preferably the materials of said sleeve 9 base upon the organic substances such as paper pipe, resinous pipe, wooden pipe, bamboo cylinder, ebonite pipe, felt cylinder and leather cylinder. Further, as a mode of working the upright portion of said draft pipe is provided at one position of the gas blowing element or several positions thereof as necessary. When a plurality of gas blowing elements are mounted in tundish, the draft pipe is arranged at the bottom of each gas blowing element, it is connected to the original gas supply pipe equipped at the outside of the tundish, passing through the bottom of the easily separable lining applied to the inner side surface of the tundish, and it is possible to fall down the gas blowing element by turning over said tundish together with the gas blowing element by disengaging the pipe joint when said element is required getting rid of. Accordingly, unlike the conventional case where piping members are fixed at the outside of tundish the piping members will not be damaged when the tundish is turned over.

Figure 7:
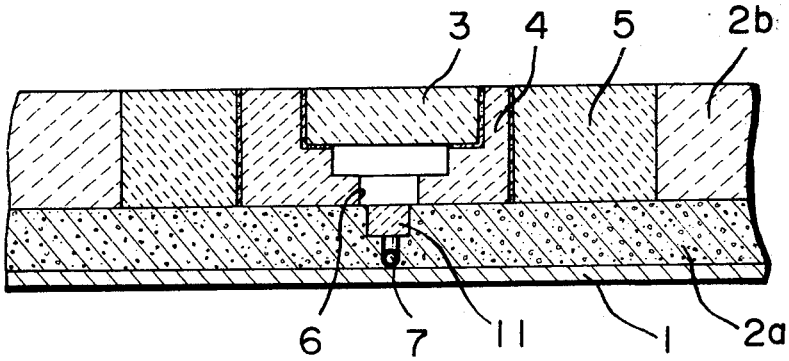
FIG. 7 is a sectional view of the easily-separable gas blowing element of the invention, in which is provided a second gas-permeable refractory moulding for the prevention of molten steel leakage.

If the easily separable gas blowing element provided in the invention is separated and floats up in the midway of use there is a danger of encroaching on the lined refractory materials at the lower surface of said blowing element by molten steel as shown in FIG. 7, so that beneath said blowing element is provided a second gas-permeable refractory moulding covering the gas guide hole 6 thereby giving a consideration to effect gas blowing without causing molten steel leakage.

Figure 6:
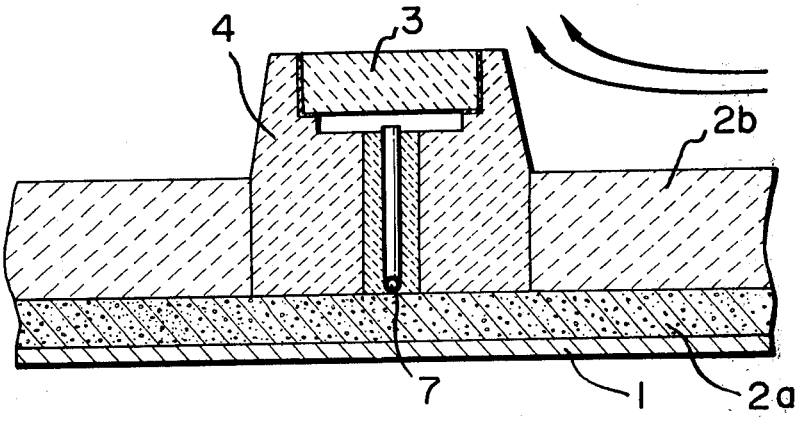
FIG. 6 is a sectional view of another embodiment of the invention, in which the easily-separable gas blowing element are provided in a projected form to form part of dam.

Further, the upper surface of said gas blowing element is positioned generally at the same level as the surface of the refractory materials of the tundish lining, said surface being in contact with molten steel, but as shown in FIG. 6 there is occasionally formed a dam and only the surface thereof is heightened so as to give turbulence to the molten steel whereby the inclusions are better floated up thanks to the stirring action of the steel by gas blowing and nozzle blocks is preventable.

It is no doubt possible to provide not only one gas blowing element at one position but also plural elements at optional positions.

Examples of the inventions are now described hereunder.

Figure 8:
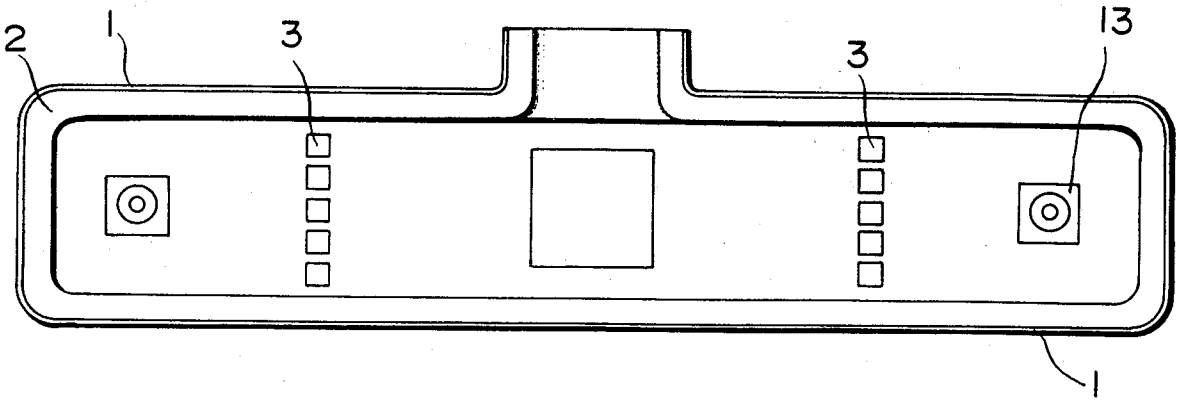
FIG. 8 is a plan view of a tundish provided with a plurality of said easily-separable gas blowing elements.

(1) Lining of tundish—two positioned nozzles
  (i) Hot melt contact portion: High alumina brick
  (ii) Other inner surfaces: "Roseki" refractories
(2) Easily-separable gas blowing element
  (i) Gas-permeable refractory moulding:
    Dimension: 200 mm square×40 mm thickness
    Material: Spheroidal mullite
    Gas permeability:
      (1) 4.0 cc·cm/cm$^2$·sec·cm $H_2O$
      (2) 1.1 cm·cm/cm$^2$·sec·cm $H_2O$
  (ii) Less gas-permeable refractory shell:
    Dimension: 250 mm square×100 mm height
    Material: Roseki, chamotte matter, fired article, having no collapsible properties by heating
    Gas permeability: 0.18 cc·cm/cm$^2$·sec·cm $H_2O$
  (iii) Non-fired refractory moulding:
    Bottom surface plate: 250 mm square×30 mm thickness
    Side panel: 100 mm×250 mm×30 mm thickness
  (iv) Refractory mortar: Mixture of high alumina cement and electrofused mullite As shown in FIG. 8, five easily-separable gas blowing elements are arranged in parallel in two lateral rows respectively between the melt fall portion and the nozzle on the brick (1) above lined at the lower portion, and all the joining portions with the lining materials are filled with refractory motar. The non-fired refractory moulding is jointly used for the bottom surface plate and the side panel, the gas guiding hole is provided single at each gas blowing element, and a 10 mm $\phi$ draft is erected.

Argon gas was blown at the rate of 0.4 l/min. per gas blowing element, 2000 t of molten steel containing 0.03% acid soluble aluminium were subjected to 8-charge continuous casting through nozzle life at 50 minutes per charge, and thereafter the tundish was turned over to fall the gas blowing elements down. Gas blowing could be carried out during the operation without any inconvenience, and the operation was smooth without interruption of working by nozzle blockade. Moreover, any abnormal phenomenon was not noticed in the internal structure of the ingot. In FIG. 8 the reference 13 designates a pouring nozzle.

What is claimed is:

1. A tundish for the casting of steel including an outer shell having an open upper end and a closed bottom end and a sidewall therebetween for containing molten metal;

a means for introducing gas into molten metal in said tundish positioned on the closed bottom end of said tundish including a generally rectangularly shaped gas permeable refractory molding having an upper and a lower surface with said upper surface being adapted to contact said molten metal, a generally rectangularly shaped gas permeable refractory inner shell engaging said refractory molding in a supporting relationship and having an upper surface and a lower surface with said upper surface being formed so as to provide a cavity between the lower surface of said gas permeable refractory molding and said gas permeable inner shell with said gas permeable inner shell having a permeability which is less than one-fifth that of said gas permeable refractory moulding; and a means for directing gas into said cavity between said gas permeable refractory moulding and said gas permeable inner shell.

2. A tundish for the casting of steel as described in claim 1 wherein said gas permeable refractory inner shell is mounted upon a non-fired refractory bottom surface plate having collapsible properties upon heating.

3. A tundish for the casting of steel as described in claim 1 wherein the outer surface of said gas permeable refractory inner shell sidewalls are in an abutting relationship with non-fired refractory side panels having collapsible properties upon heating.

4. A tundish for the casting of steel as described in claim 1 wherein said gas permeable refractory molding is fabricated from a material selected from the group consisting of mullite, corandum, alumina, silicon carbide, zirconia and zirconium silicate, and the gas permeable is higher than 0.9 cc·cm/cm$^2$·sec·cm $H_2O$.

5. A tundish for the casting of steel as described in claim 1 wherein said gas permeable refractory inner shell is a molded article consisting of one or more materials selected from the group consisting of siliceous sand, chamotte, mullite, alumina, magnesia, peridotite, bauxite, brick powder, natural mineral powder, diatomaceous earth, pearite, silicate, asbestos, rock wool, slag wool, glass wool, carbonaceous fibers, silicon carbide fibers, kaolin fibers, carbonaceous materials (including resin, protein, carbohydrate, fibers, viscous substances, heavy mineral oil, animal fat, vegetable oil, gum matter, graphite, coke, wood powder, charcoal and coal), raw materials, products, semi-products and waste containing one or more of the carbonaceous materials; and at least part of the surface of said gas permeable refractory shell is gas-impermeably treated to decrease gas permeability.

6. A tundish for the casting of steel as described in claim 1 wherein said gas permeable refractory inner shell is provided with more than one gas guiding hole.

7. A tundish for the casting of steel as described in claim 6 wherein said means for directing gas into said cavity comprises a draft pipe inserted into each of said gas guiding holes of said gas permeable refractory inner shell.

8. A tundish for the casting of steel as described in claim 7 wherein a separable sleeve is inserted between the inner wall of said gas guiding hole of said gas permeable refractory inner shell and the outer wall of said draft pipe.

9. A tundish for the casting of steel as described in claim 1 wherein said means for introducing gas into said molten metal forms at least part of a dam for said molten metal.

10. A tundish for the casting of steel as described in claim 1 wherein a second gas permeable refractory molding is mounted beneath the bottom of said means for introducing gas.

11. A tundish for the casting of steel as described in claim 7 wherein said draft pipe extends above the inner end surface of said gas permeable refractory inner shell.

* * * * *